US006382989B1

(12) United States Patent
Yu

(10) Patent No.: US 6,382,989 B1
(45) Date of Patent: May 7, 2002

(54) SURFACE MOUNT ELECTRICAL SOCKET CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,578

(22) Filed: Dec. 27, 2000

(30) Foreign Application Priority Data

Nov. 17, 2000 (TW) ..... 089219335

(51) Int. Cl.[7] ..... H01R 13/502
(52) U.S. Cl. ..... 439/83; 439/686; 439/701
(58) Field of Search ..... 439/83, 876, 701, 439/686, 689, 74, 752

(56) References Cited

U.S. PATENT DOCUMENTS 5,026,304 A * 6/1991 Furrow ..... 439/686
6,135,821 A * 6/1991 Liu ..... 439/701
5,122,077 A * 6/1992 Maejima et al. ..... 439/701
5,340,320 A * 8/1994 Puerner ..... 439/686
5,535,513 A * 7/1996 Frantz ..... 439/83
5,975,916 A * 11/1999 Okura ..... 439/74

* cited by examiner

*Primary Examiner*—Gary Paumen
(74) *Attorney, Agent, or Firm*—Wei Te Chung

(57) ABSTRACT

A rear socket for a PCMCIA connector includes a housing (1), a plurality of surface mount terminals (2) received in the housing (1), and a pair of covering plates (3) secured to two main side faces (12, 12') of the housing (1). Each terminal (2) has a web (20), a soldering tail (24) extends outwardly in an inner face (202) of the web (20). A block (110) is formed by the housing (1) and abuts against an inner face (202) of each of the webs (20), and the covering plate (3) abuts against an outer face (201) of each of the web (20), whereby soldering wicking problem can be effectively prevented when surface mounting the connector (100) to a printed circuit board (6).

1 Claim, 4 Drawing Sheets

SURFACE MOUNT ELECTRICAL SOCKET CONNECTOR

BACKGROUND OF THE INVENTION

1. Field of the Invention

The present invention relates to an electrical connector, and particularly to a surface mount electrical socket connector which can prevent solder wicking of terminals of the connector during surface mounting the connector to a printed circuit board (PCB).

2. Brief Description of the Prior Art

An electrical connector is mounted on a PCB for electrically connecting an electronic device (for example, a personal computer memory card interface association (PCMCIA) card connector) to the PCB. When the electrical connector is mounted onto the PCB by surface mounting technology (SMT), solder wicking of terminals of the connector is a problem, which may cause a contamination of the terminals thereby adversely affectively signal transmission quality between the electronic device and the PCB.

Hence, an improved surface mount electrical connector is required to overcome the disadvantages of the prior art.

BRIEF SUMMARY OF THE INVENTION

An object of the present invention is to provide a surface mount connector which can effectively prevent molten solder from wicking into the connector to contaminate the terminals during surface mounting the connector to a printed circuit board.

To achieve the above-mentioned object, a connector in accordance with the present invention includes a dielectric housing, a plurality of terminals, and two plates. The housing defines a top face, a mounting face opposite the top face, and a pair of main side faces between the top and mounting faces. A plurality of terminal receiving openings is defined in each of the side faces, and pluralities of passages are defined in the top surface and communicate the openings. A block is in a lower portion of each opening. Each terminal comprises a web, a pair of mounting arms extending from two lateral sides of the web and fitting into two corresponding slits defined by housing beside a corresponding block, a pair of mating portions upwardly extending from the mounting arms and received in a corresponding passage for engaging with a complementary terminal of a PCMCIA card connector, a mounting tab extending from a top edge of the web into a recess defined in the corresponding block and a solder tail extending from a bottom edge of the web for surface mounting to a printed circuit board. Each web has an inner face abutting against an end face of a corresponding block, and an outer face abutted by a covering plate secured to one of the main side faces of the housing. Thus, solder wicking problem when the connector is surface mounted to the printed circuit board can be effectively avoided.

Other objects, advantages and novel features of the present invention will become more apparent from the following detailed description of the present embodiment when taken in conjunction with the accompanying drawings.

DETAILED DESCRIPTION OF PREFERRED EMBODIMENT

Referring to the attached drawings, an electrical connector in accordance with the present invention is a surface mount rear socket for connecting a PCMCIA card connector to a motherboard. The PCMCIA card connector has right angled terminals with tails inserted into the rear socket to engage with terminals thereof that in turn are surface mounted on the motherboard. The PCMCIA card connector of this type is well known in the art and has nothing to do with the claimed scope of the present invention; thus, a detailed description thereof is omitted.

Figure 1:
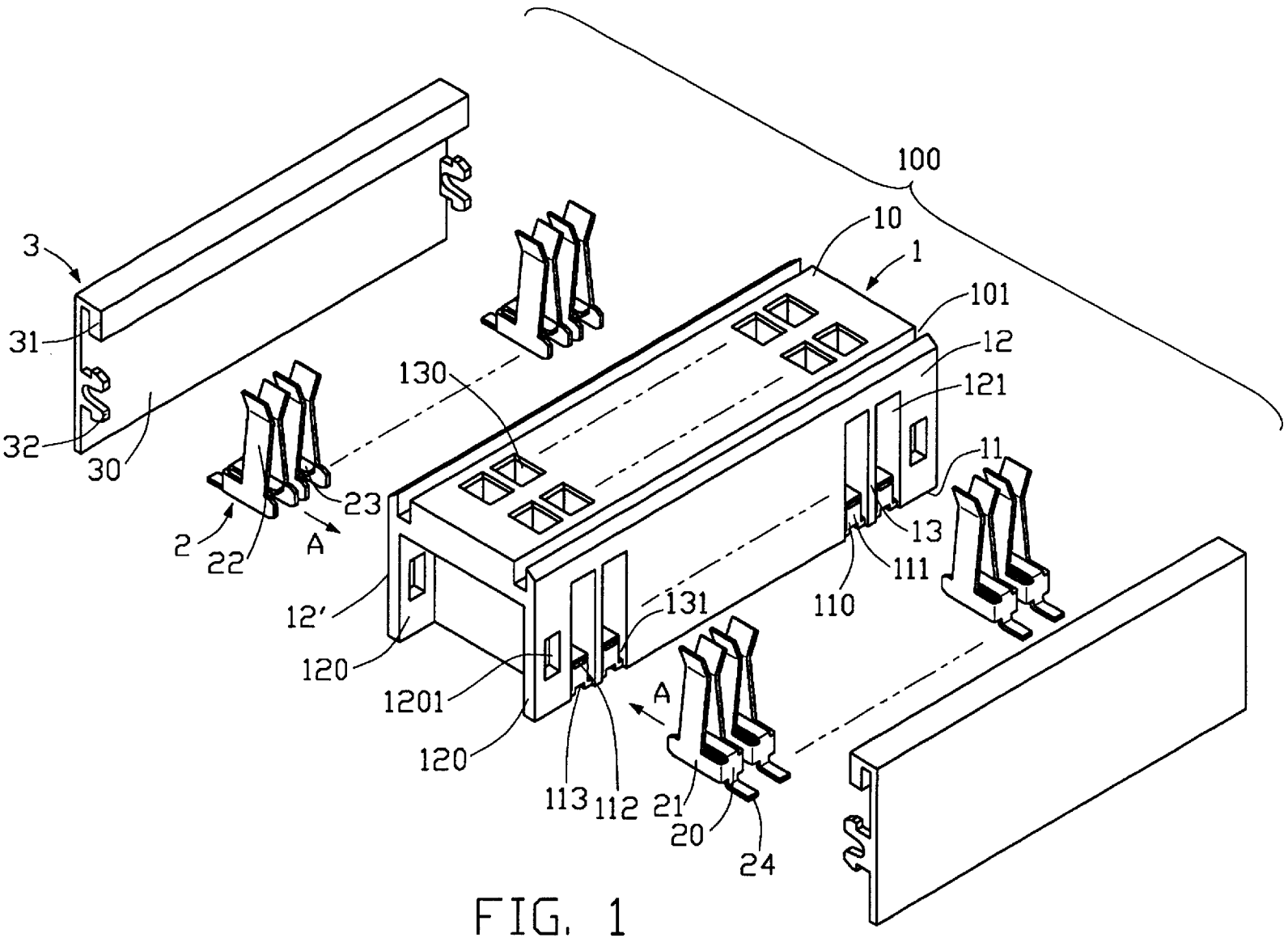
FIG. 1 is an exploded view of the electrical connector of the present invention.
Figure 2:
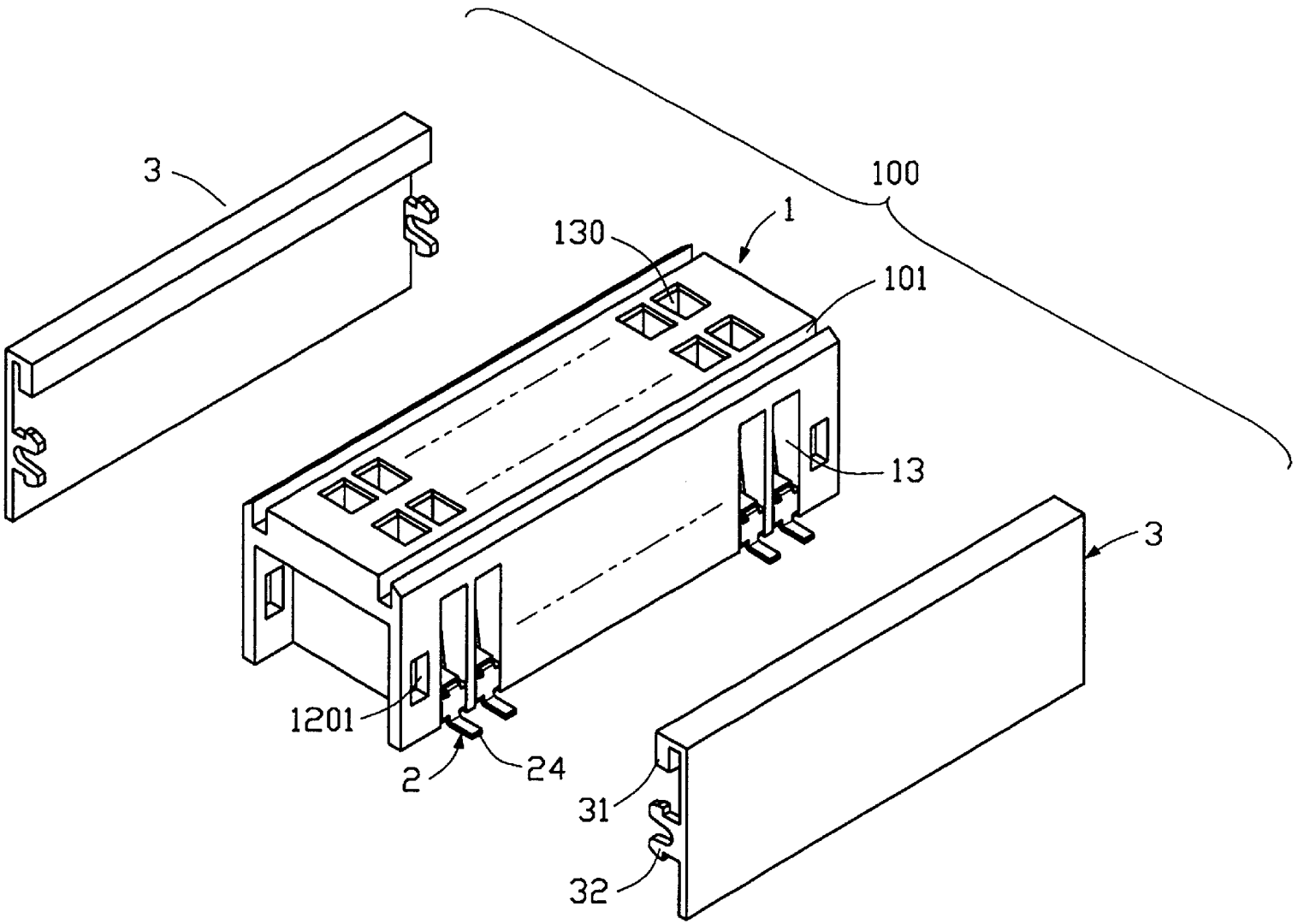
FIG. 2 is an exploded view of the electrical connector of the present invention with terminals being mounted to a housing of the connector.

Particularly referring to FIG. 1, the electrical connector 100 comprises a substantially cuboidal dielectric housing 1, a plurality of terminals 2, and two plates 3 to be fixed to front and rear faces 12, 12' of the housing 1.

The housing 1 defines a top face 10 and a mounting face 11 opposite the top face 10. The top and mounting faces 10, 11 are between front and rear faces 12, 12'. The top face 10 provides a pair of keyways 101 therein near the front and rear faces 12, 12', respectively. Four mounting plates 120 are integrally formed on four corners of the housing 1. Each plate 120 defines a rectangular mounting hole 1201 therethrough. A row of parallel, vertically oriented openings 121 are defined in each of the front and rear faces 12, 12' and is inwardly extended toward a center of the housing 1. Corresponding to the openings 121, a plurality of passages 130 are vertically defined in the housing 1 through the top face 10 toward the mounting face 11, and communicate with the openings 121, respectively. Every two neighboring openings 121 are spaced by a partition 13. Also referring to FIG. 4, the housing 1 further forms a block 110 extending in a lower portion of two front-to-rear aligned openings 121. Each block 110 has front and rear end faces 111, 111'. Each end face 111 (111') defines a recess 112 therein. A slit 131 is defined between each of two sides of each block 111 and a correspondingly neighboring partition 13. A groove 113 is defined in a bottom face of each block 111 and extends from the end face 111 (111') toward the center of the housing 10. A standoff 132 is formed by the block 111 and between the grooves 113.

Each terminal 2 comprises a web 20, a pair of mounting arms 21 perpendicularly horizontally extending from two lateral sides of the web 20, a pair of mating portions 22 perpendicularly upwardly extending from the pair of mounting arms 21, respectively, a mounting tab 23 extending from an upper edge of the web 20 and between the mounting arms 21, and a solder tail 24 extending from a bottom edge of the web 20 and opposite the mounting tab 23. The web 20 has a thickness which is substantially the same as a distance between the front face 12 (rear face 12') and the front end face 111 (rear end face 111'); thus, when the terminal 2 is mounted on the housing 1, an out face 201 of the web 20 is flush with the front face 12 or the rear face 12'. Each plate 3 has a rectangular flat main body 30, an L-shaped hook 31 extending from a top edge of the main body 30 and a pair of latches 32 extending from two lateral sides of the main body 30, respectively.

Figure 3:
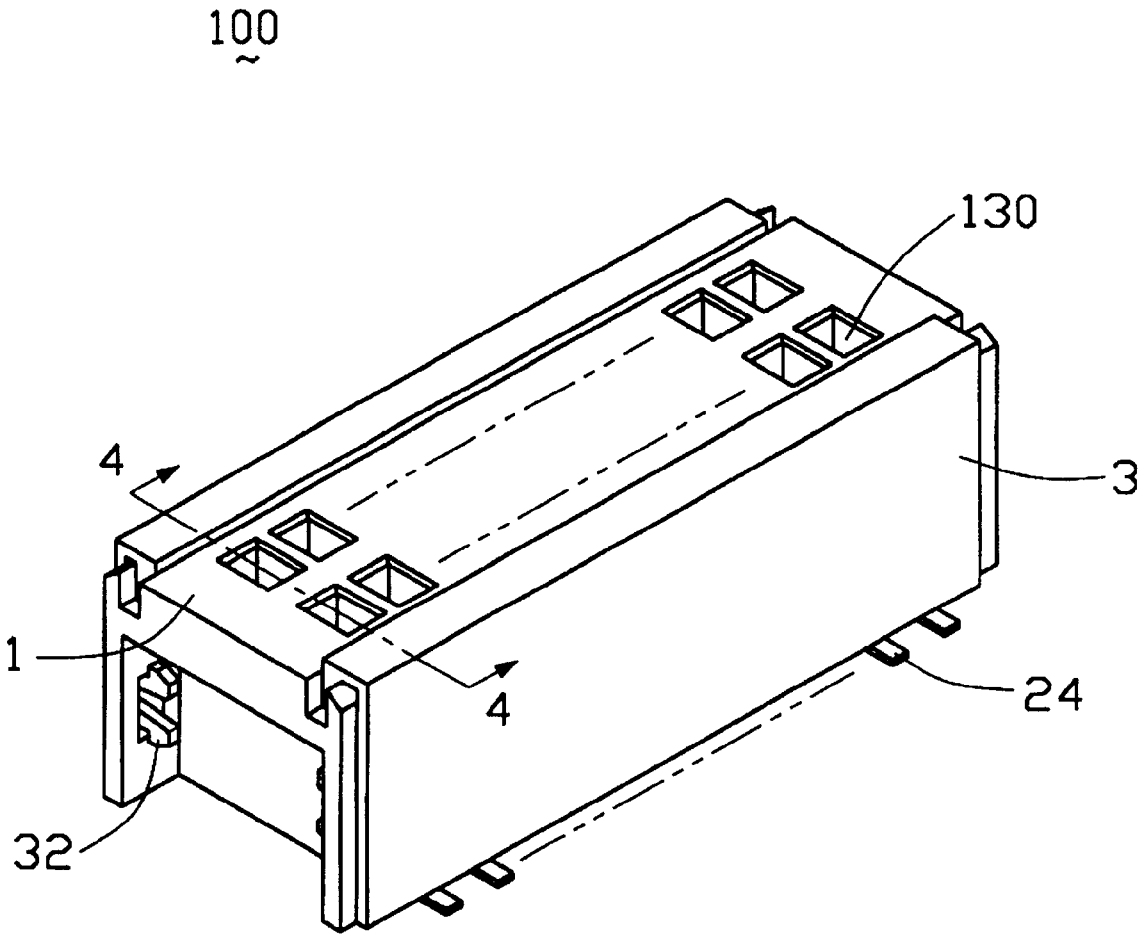
FIG. 3 is a perspective view of an electrical connector of the present invention.
Figure 4:
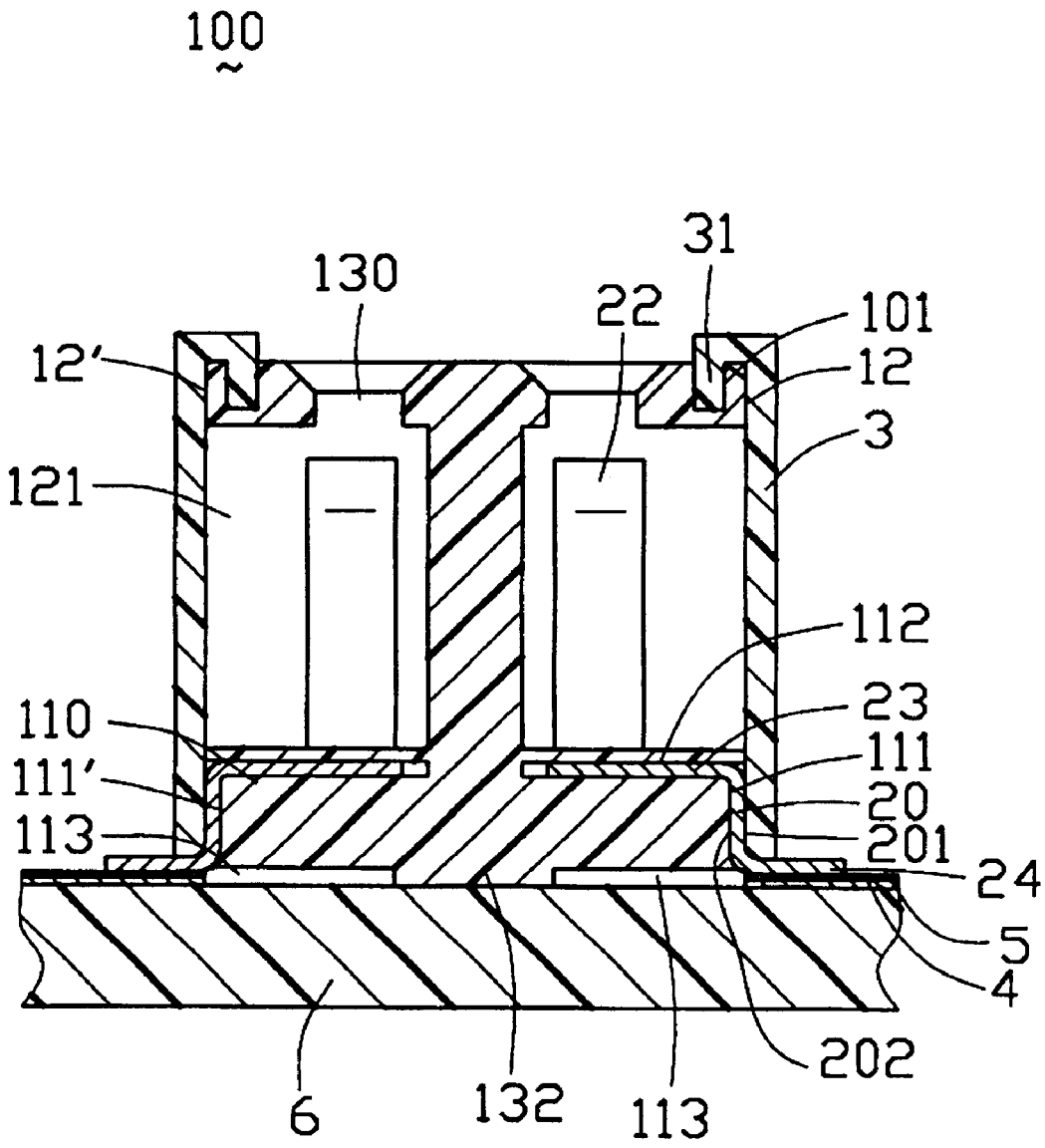
FIG. 4 is a cross-sectional view taken along line 4—4 of FIG. 3, in which the connector is surface mounted on a PCB.

In assembly, also referring to FIG. 3 and 4, the terminals 2 are first assembled to the housing 1 by inserting the terminals 2 into corresponding openings 121 alone a direction A to reach an assembled position. At the assembled position, the webs 20 abut the front and rear face 111, 111' of the blocks 110. The solder tails 24 forwardly and rearwardly extend from the mounting face 11. The mounting tabs 23 are fixedly fitted into the recesses, respectively 112. The mounting arms 21 are fitted in corresponding slits 131. And the mating portion 22 each are vertically received in a corresponding vertical passage 130. The mating portions 22 are used for engaging with tail portion 24 of the right-angled terminal of the PCMCIA connector.

After the terminals 2 are assembled the housing 1, the plates 3 are secured to the front and rear faces 12, 12' of the housing 1 to further fix the terminals 2 to the housing 1. The plates 3 are secured to the housing 1 by fitting the keys 31 into the keyways 101 and the latches 32 through the mounting holes 1201 to latch with the mounting plates 120.

Particularly referring to FIG. 6, the solder tails 24 of the terminals 2 are mounted on solder pads 4 on circuit lines 4 of a PCB 6 in which the standoff 132 abuts a top face of the PCB 6. As outer and inner faces 201, 202 of each web 20 of each terminal 2 are respectively abutted against by end face 111 (111') of a corresponding block 110 and a corresponding plate 3, molten solder generated when the solder pads 5 are subject to infra red (IR) reflow to surface mount the connector 100 to the PCB 6 contaminate the mating portion 22. Thus, the present invention can effectively solve the problem of solder wicking of surface mount rear socket for a PCMCIA connector. Further, the grooves 113 are so devised that they can accommodate the molten solder.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a top face, a mounting face opposite the top face, and front and rear faces between the top and mounting faces, a plurality of openings being formed in each of the front and rear faces, a plurality of vertical passages being defined through the top face toward the bottom face and communicating with corresponding openings, a block being formed in a lower portion of a corresponding opening;

a plurality of terminals mounted in corresponding openings, each terminal comprising a web having an inner face abutting against an end face of a corresponding block, a surface mounting tail adapted for surface mounting to a printed circuit board extending from a lower portion of the web and a mating portion adapted for engaging a terminal of a complementary electronic device extending vertically from the web and received in a corresponding passage; and a pair of covering plates secured to the front and rear faces of the housing, respectively, each plate abutting against an outer face of the web of a corresponding terminal whereby solder wicking problem can be effectively prevented when the connector is surface mounted to a printed circuit board.

wherein each block defines a recess in the end face thereof, each terminal having a mounting tab extending from an upper portion of the web in a direction opposite the tail and fitting into the recess;

wherein the housing forms a partition between two neighboring openings, two slits being defined between each block and two neighboring partitions, each terminal forming two mounting arms extending from lateral sides of the web, the mounting arms being fittingly received in two corresponding slits;

wherein the top face of the housing provides a pair of keyways and the covering plates each comprise an upper key engaging into a corresponding keyway.

* * * * *